United States Patent [19]

Chinchar

[11] Patent Number: 4,595,309

[45] Date of Patent: Jun. 17, 1986

[54] MARGIN EXTENSIONS FOR PADS

[76] Inventor: Victor M. Chinchar, Two King James South #175, 24650 Center Ridge Rd., Westlake, Ohio 44145

[21] Appl. No.: 676,631

[22] Filed: Nov. 30, 1984

[51] Int. Cl.[4] ..... B42F 13/00

[52] U.S. Cl. ..... 402/80 R

[58] Field of Search ..... 402/80 R, 75, 58, 500; 281/1, 2, 9, 22

[56] References Cited

U.S. PATENT DOCUMENTS

| | | | |
|---|---|---|---|
| 509,533 | 11/1893 | Hatton | 402/80 R |
| 587,076 | 7/1897 | Dehn | 402/80 R |
| 2,093,041 | 9/1937 | Emery | 402/80 R |
| 3,620,553 | 11/1971 | Donovan | 402/80 R |
| 4,289,331 | 9/1981 | Finger et al. | 402/80 R |
| 4,403,883 | 9/1983 | Sorin | 402/80 R |
| 4,479,733 | 10/1984 | Segal | 402/80 R |

*Primary Examiner*—Paul A. Bell
*Assistant Examiner*—Paul M. Heyrana
*Attorney, Agent, or Firm*—Paul L. Hickman

[57] ABSTRACT

A pad with an extended margin is disclosed which includes a backing member that is wider than a pad of paper which is attached to it. The resulting margin is provided with three holes receptive to the rings of a binder, and right angle slits connect the holes to the longitudinal edge of the margin extension. These slits permit the pad to be inserted and removed from the binder without opening or closing the rings of the binder. A retrofit extension margin is also described which can attach various items within a ring binder.

3 Claims, 9 Drawing Figures

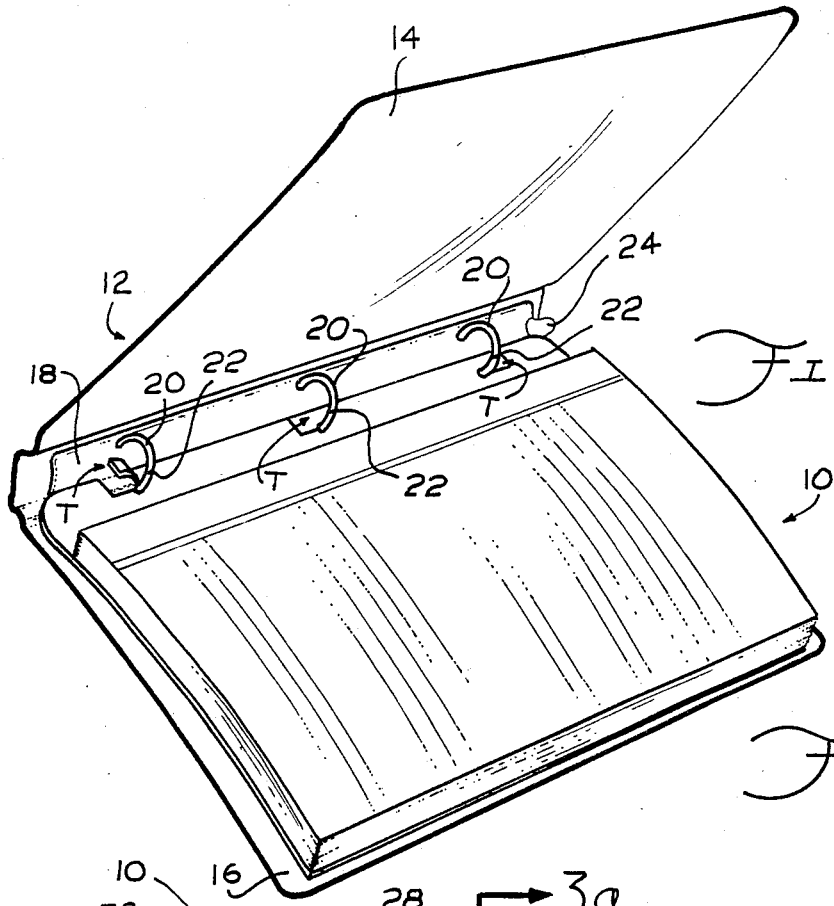
FIG. 1
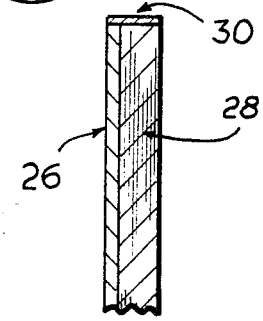
FIG. 3a
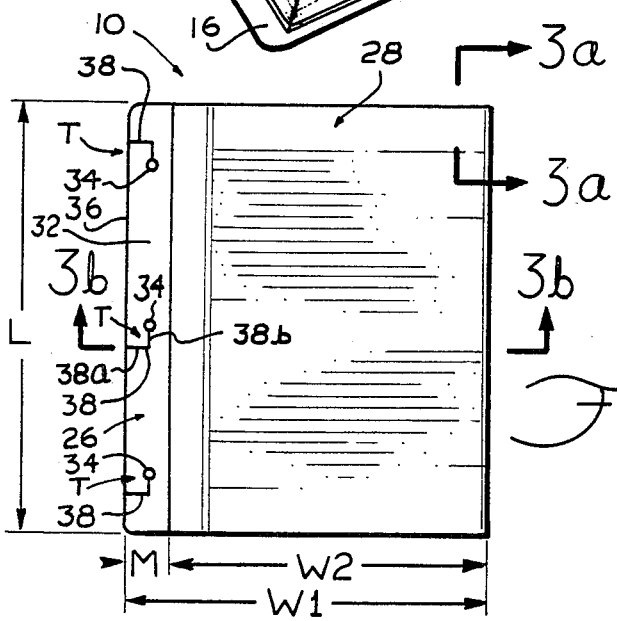
FIG. 2
FIG. 3b
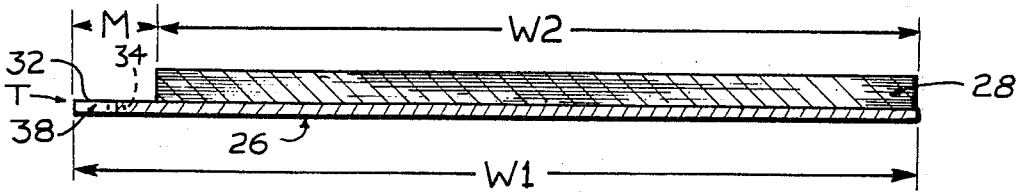

MARGIN EXTENSIONS FOR PADS

BACKGROUND OF THE INVENTION

1. Field of the Invention

This invention relates generally to stationery supplies and more particularly to ring binder materials.

2. Description of the Prior Art

Ring binders include a cover, an elongated base or spine attached to the inside center of the cover, and two or more rings attached to the spine. The rings may be opened and closed individually, or a mechanism may be provided in the spine which opens and closes the rings simultaneously.

Binders are convenient in that pages may be inserted into or removed from any position within the binder without disturbing the remaining pages. To be utilized with a ring binder, however, the pages must be provided with marginal holes to engage the binder's rings.

Many types of papers, pads, catalogs, material samples, booklets, reference cards, etc. are not provided with such holes. For example, a legal pad including a rectangular, cardboard backing member and a pad of paper attached to the backing member is not typically provided with marginal holes. Also, spiral notepads are often incompatible with a ring binder.

A solution which partially addresses this problem is to provide such legal pads, spiral notebooks, booklets, reference cards, etc. with holes that can engage the rings of a binder. However, to utilize the modified pads and notebooks, it is necessary to frequently open and close the rings of the binder, producing considerable annoyance both to the user and to people around him.

In U.S. Pat. No. 1,843,771 of Kline a binding strip is disclosed including a strip of material which is gummed on one side and which is provided with holes along one longitudinal edge. The gummed sided of the strip is attached to a paper or pad, and the holes are engaged with the rings of a binder. The rings of the binder must be opened to engage or disengage the binding strip with the rings.

In U.S. Pat. No. 818,130 of Swan a detachable leaf for books is described which has a number of holes provided along one edge which are connected to the edge with L shaped slots. The holes engage staples of the book during the binding process and are permanently affixed thereto. Swan's leaf is not adapted for use with ring binders.

SUMMARY OF THE INVENTION

An object of this invention is to provide margin extensions for ring binder materials which securely retains pads, catalogs, booklets, material samples, reference cards, etc. within a ring binder.

Another object of this invention is to provide a pad of unitary construction which retains the advantages of standard pads, but which also may be utilized with a ring binder.

Another object of this invention is to provide a retrofit device which provides a margin extension for various materials including those previously mentioned.

A still further object of this invention is to provide margin extensions for ring binder materials as described above which can be engaged and disengaged from the rings of the binder without opening the rings of the binder.

One embodiment of this invention includes a rectangular backing member and a pad of paper attached to the backing member. The width of the backing member is greater than the width of the backing paper such that an extended margin is formed. The extended margin is provided with plurality of holes appropriately spaced and positioned to engage the rings of a binder, and right angle slits connecting the holes to the edge of the backing member.

Another embodiment of this invention is retrofit margin for standard pads which includes a plurality of spaced holes receptive to the rings of the binder, and perforations or slits connecting the holes to the edge of the margin extension device. An opposing edge of the device is provided with an adhesive strip which attaches the margin extension to the backing of a standard pad of paper.

An advantage of this invention is that pads of paper can be neatly and efficiently retained within a ring binder.

Another advantage of this invention is that the rings of the binder do not have to be opened to insert or remove the pads from the notebook.

These and other objects and advantages of the present invention will no doubt become apparent upon a reading of the following descriptions and a study of the several figures of the drawing.

BRIEF DESCRIPTION OF THE DRAWING

FIG. 1 is a perspective view of a pad with extended margins engaged with the rings of a binder;

FIG. 2 is a plan view of the pad with extended margins;

FIG. 3A is a cross section taken along line 3A—3A of FIG. 2;

FIG. 3B is a cross section taken along line 3B—3B of FIG. 2;

DETAILED DESCRIPTION OF THE PREFERRED EMBODIMENT(S)

Figure 4:
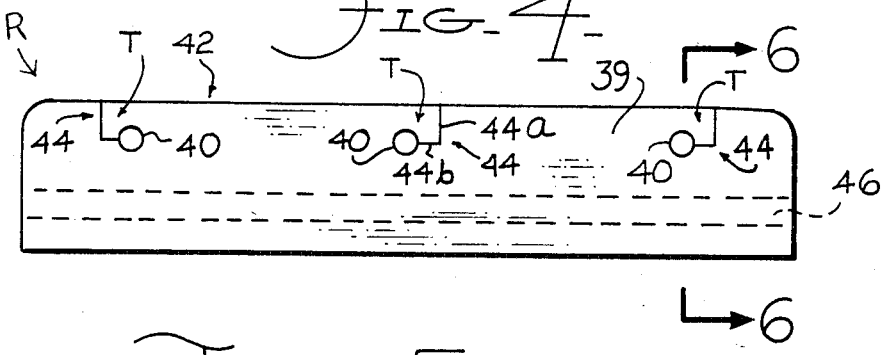
FIG. 4 is a plan view of a retrofit margin extension in accordance with the present invention.

Referring to FIG. 1, a pad with extended margin 10 is shown attached within a three-ring binder 12 which includes a front cover 14, a rear cover 16, a spine member 18, and three rings 20 supported by spine 18. The rings are simultaneously opened and closed at their junctures 22 by a mechanism within spine 18 that is actuated by a lever 24.

Referring to FIGS. 2, 3A, and 3B, the pad 10 includes a rectangular backing member 26 which is preferably made from cardboard, plastic, or other suitable material. Backing member 26 has a length L and a width W1. Attached to backing member 26 are a plurality of sheets of paper 28 (best seen in FIG. 3A), where their upper lateral edge are adhesively attached together with a strip 30.

Strip 30 also attaches the sheets of paper 28 to backing 26. Other methods of attachment, such as spiral metal or plastic coils, can also be used.

The sheets of paper 28 have the same length L as backing 26, but have a shorter width W2. Since the right side edge of sheets of paper 28 (as seen in FIG. 2) are substantially aligned with the right side edge of backing 26, a margin 32 is formed on the left side of the backing member 26 having a width M.

The margin M is provided with a number of holes 34 which are connected to the longitudinal edge 36 of margin 32 by perforations, slots, or slits 38. The slits 38 include a first portion 38A which is substantially perpendicular to longitudinal edge 36, and a second portion 38B which is substantially parallel to longitudinal edge 36. Thus, in the present embodiment, slit 38 forms a right angle in connecting holes 34 to longitudinal edges 36.

Other embodiments of this invention include other configurations for slit 38 including, but not limited to, a button-hook shaped slit. A still further embodiment of this invention does not include slits 38, which results in pad wherein individual sheets of paper may be removed without opening the rings of the binder, but where the rings of the binder must be opened to remove or insert the pad into the binder.

In use, holes 34 of margin 32 are engaged with rings 20 of binder 12 either by opening the rings and engaging them with the holes 34 in a traditional matter, or by bending back the flexible tabs T formed by slits 38 and engaging the holes 34 with the rings 20 without opening the rings. The tabs T, one of which is shown partially bent back in FIG. 1, are movable between an open position wherein the margin 32 can be engaged or disengaged with the rings 20 of binder 12, and a closed position where they are substantially planar with the remainder of margin It should be noted that one of the slits 38 is preferably positioned on a different side of its respective hole 34 to prevent margin 32 from becoming accidentally disengaged from the rings 20 due to a longitudinal force exerted upon the pad 10. Alternatively, all of the slits 38 could be positioned on the same side of their respective holes 34.

Figure 5:
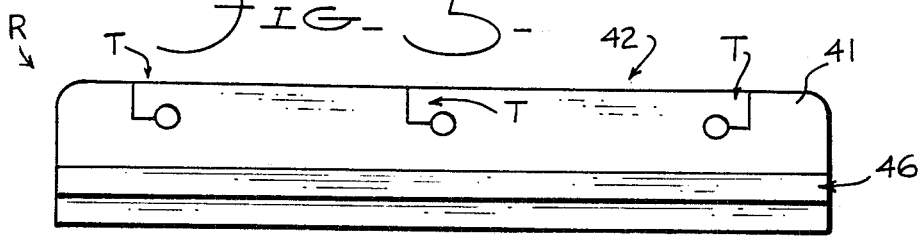
FIG. 5 is the opposing plan view of the plan view of FIG. 4.
Figure 6:
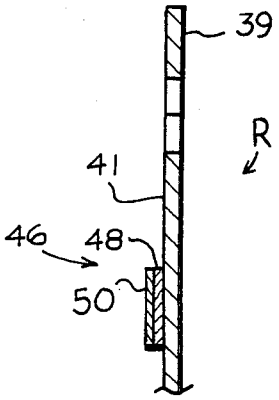
FIG. 6 is a cross section taken along line 6—6 of FIG. 4.

Referring now to FIGS. 4, 5, and 6, a retrofit margin extension R having a first side 39 and a second side 41 is preferably made from cardboard, plastic, or other suitable material and is provided with a plurality of holes 40 connected to a longitudinal edge 42 of the margin extension R by perforations, slots, or slits 44. As previously described, the slits 44 include a first portion 44A and a second portion 44B which is formed at substantially right angles to first portion 44A.

One side of margin extension R is provided with an attachment member 46 including a double sided adhesive tape 48 attached to side 41 of margin extension R, and having its other side covered with a protective covering 50. The attachment member is used to couple the margin extension R to a standard pad of paper, or to a catalog, booklet, reference card, material sample, etc.

Figure 7:
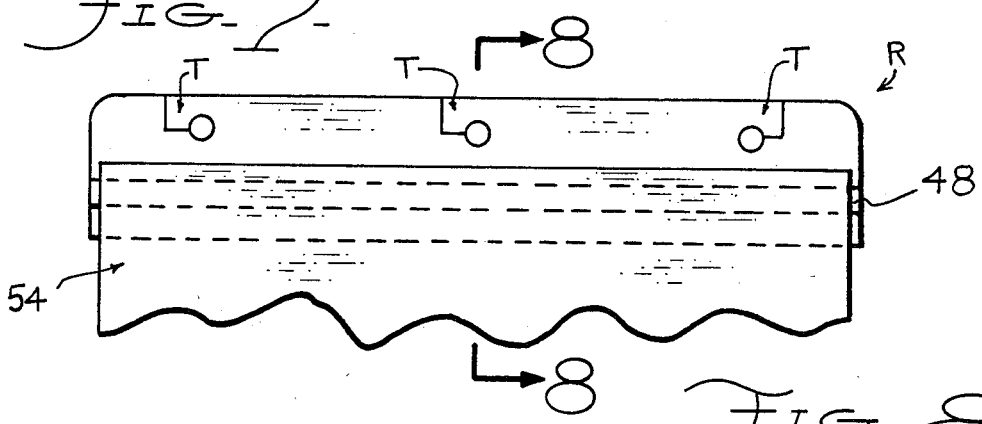
FIG. 7 is a plan view of the retrofit margin extension attached to the backing member of a pad of paper.
Figure 8:
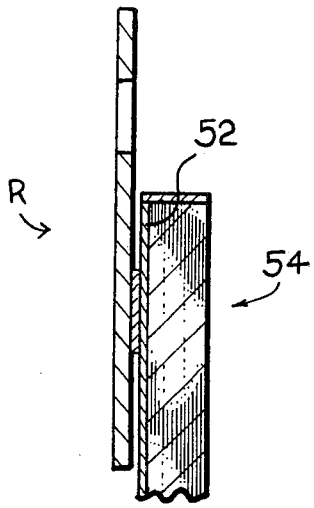
FIG. 8 is a cross section taken along line 8—8 of FIG. 7.

With reference to FIGS. 7 and 8, to use the margin extension R of the present invention, the protective covering 50 is removed from adhesive tape 48, and the backing member 52 of a pad 54 is pressed against it. This action firmly attaches pad 54 to margin extension R such that a standard pad 54 can be utilized with a ring binder as previously described.

While this invention has been described in terms of a few preferred embodiments, it is contemplated that persons reading the preceding descriptions and studying the drawing will realize various alterations, permutations and modifications thereof. It is therefore intended that the following appended claims be interpreted as including all such alterations, permutations and modifications as fall within the true spirit and scope of the present invention.

What is claimed is:

1. A margin extension comprising an elongated, flexible planar member having a first longitudinal edge and a second longitudinal edge, said planar member being provided with a plurality of linearly spaced apart round holes adapted to engage a corresponding plurality of rings of a looseleaf binder, said holes being formed substantially equidistantly from said first longitudinal edge; said planar member being provided with a plurality of slit configurations where each of said slit configurations joins an associated hole to said first longitudinal edge, said slit configurations each including a first slit segment which is perpendicular to said first longitudinal edge and which does not intersect said associated hole, and a second slit segment which is parallel to said first longitudinal edge and which connects said first slit segment to said associated hole, such that a flexible tab portion is formed at each hole which extends in a direction parallel to said first longitudinal edge; and attachment means provided proximate said second longitudinal edge and adapted to attach an item to said planar member.

2. A margin extension as recited in claim 1 wherein at least one of said tab portions extends in an opposite direction as the remainder of said tab portions.

3. A margin extension as recited in claim 1 wherein said attachment means comprises an adhesive, and further comprising a protective strip covering said adhesive prior to its application to said item.

* * * * *